United States Patent [19]

Aston et al.

[11] 3,965,949

[45] June 29, 1976

[54] PENCIL SHARPENERS

[75] Inventors: Jack Ralph Aston; Ronald Whitehouse, both of Dudley, England

[73] Assignee: Joseph Gillott & Sons Limited, Dudley, England

[22] Filed: Oct. 10, 1974

[21] Appl. No.: 513,644

[30] Foreign Application Priority Data

Oct. 12, 1973 United Kingdom ..... 47721/73

[52] U.S. Cl. ..... 144/28.71

[51] Int. Cl.[2] ..... B43L 23/04

[58] Field of Search ..... 144/28.1, 28.11, 28.3, 144/6, 7, 28.71, 28.8, 28.5, 30; 220/76

[56] References Cited

UNITED STATES PATENTS

| | | | |
|---|---|---|---|
| 1,810,284 | 6/1931 | Luppert | 144/28.6 |
| 2,575,069 | 11/1951 | Rankin | 220/76 X |
| 3,227,140 | 1/1966 | Brand | 144/28.71 |
| 3,410,169 | 11/1968 | Kobayashi | 144/28.1 X |
| 3,750,724 | 8/1973 | Dahle | 144/28.1 |

FOREIGN PATENTS OR APPLICATIONS

| | | | |
|---|---|---|---|
| 604,939 | 9/1960 | Canada | 144/28.7 |
| 808,425 | 1/1951 | Germany | 144/28.6 |
| 820,101 | 11/1951 | Germany | 144/28.71 |
| 369,279 | 2/1923 | Germany | 144/28 |
| 716,549 | 1/1942 | Germany | 144/28.7 |

*Primary Examiner*—Al Lawrence Smith
*Assistant Examiner*—Gary L. Smith
*Attorney, Agent, or Firm*—Marshall & Yeasting

[57] ABSTRACT

The invention provides a pencil sharpener construction having a planetarily moved cutter assembly located within the body of the pencil sharpener, and the body is divided into two parts meeting at a plane or planes containing the axis of the planetary motion and secured together about the cutter unit, so that several different designs of cutter units can be accommodated without varying the design of the body parts.

1 Claim, 7 Drawing Figures

PENCIL SHARPENERS

BACKGROUND OF THE INVENTION

This invention relates to pencil sharpeners of the kind in which a cutter is rotated about an axis and the axis is moved planetarily about the pencil. Such sharpeners are usually desk or wall mounted, as distinct from being hand held in use. Several different versions of such sharpeners are known, including ones in which a chuck is provided to grip the pencil and spring means are provided to feed the pencil inwardly of the sharpener as sharpening proceeds, as the alternative to holding the pencil with one hand whilst the rotation is effected by a crank handle with the other hand. In another version, a selector plate is provided having a row of holes of different sizes, and the pencil is inserted through the hole of the appropriate size in order to support and centralise the pencil with respect to the cutter. It is also known to provide either a single cutter or two or more cutters pitched apart about the axis of the pencil or its support.

Hitherto, the cutter, pencil support and rotating mechanism have been made as a single unit which is usually inserted axially into a unitary body which forms both a frame to support the rotating parts and journal them, and also forms an enclosure to protect the user from the cutters and also protect the cutters from damage. This body has been made as a one-piece die casting, thus giving a satisfactory aesthetic appearance and the necessary rigidity but particularly because of the many alternative versions which are required, the casting has been particularly complex and has hence required a complex mould. Such a mould is expensive and can only be justified if particularly high volumes of production can be ensured.

As an alternative, the body is often made from a number of separate metal pressings which are assembled together, and this enables simpler parts to be used and in some cases a selection will be made from different components according to the particular version which is to be produced. This certainly reduces tool cost, but increases the actual cost of manufacture because of the number of assembly steps involved in making the body.

SUMMARY OF THE INVENTION

The objects of the present invention are to provide a new design which may be produced more cheaply, and allows a number of different versions to be produced utilising at least substantially the same body, but without involving complexity in assembly.

In accordance with the present invention considered broadly, a pencil sharpener of the kind referred to comprises a two-piece body, the two pieces meeting at a plane or planes containing the axis of the planetary motion, and the pieces being secured together about the cutter and pencil support.

The cutter and pencil support, together with the rotating mechanism may continue to be made as the unitary assembly, but because the body parts meet at a plane containing the axis of rotation of that assembly, the design of the body parts is substantially simplified and for example it is unnecessary to provide catch parts to hold the assembly within the body. Moreover, journal bearings for the rotating parts may be provided on each of the two mating body parts and hence can be formed in moulding the body without the use of cores, so that the tools for making the body parts can be much simpler. Preferably the body parts are made as mouldings from a synthetic plastics material, for example a nylon. By suitable selection of material for the bearing surfaces of the rotating parts, for example a glass filled nylon, separate bearings can be avoided.

One of the complexities in the manufacture of pencil sharpeners of this kind is that different designs of cutter may require different locations of the annulus gear which provides the planetary motions; hitherto this has needed different body components.

In accordance with a feature of the present invention, the annulus gear comprises a plate which is located in the body parts in recesses provided for the purpose, and the body parts are provided with a plurality of such recesses adapted for use respectively according to the desired location of the annulus gear. Hence, it is unnecessary to provide different parts for the body according to which of the possible cutter designs is selected from this view point.

The body parts may also be adapted to support an apertured selector plate, or a chuck mechanism and spring means for drawing the pencil into the sharpener, and enable the same body parts to be used irrespective of the selection of design from these further aspects.

DESCRIPTION OF THE PREFERRED EMBODIMENT

Figure 7:
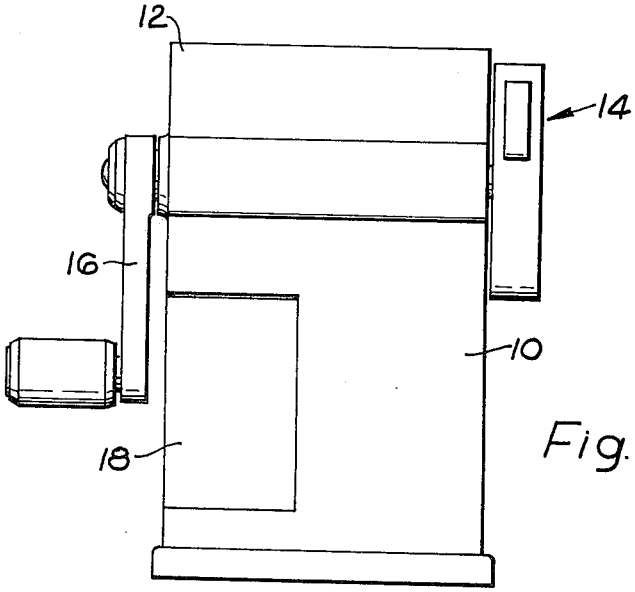
FIG. 7 is an opposite side elevation of the complete pencil sharpener.

Referring first to FIG. 7 of the drawings, the sharpener comprises a two part body 10, 12, a chuck and feed mechanism generally indicated by the reference 14, a crank handle 16 and a shavings container 18.

Figure 3:
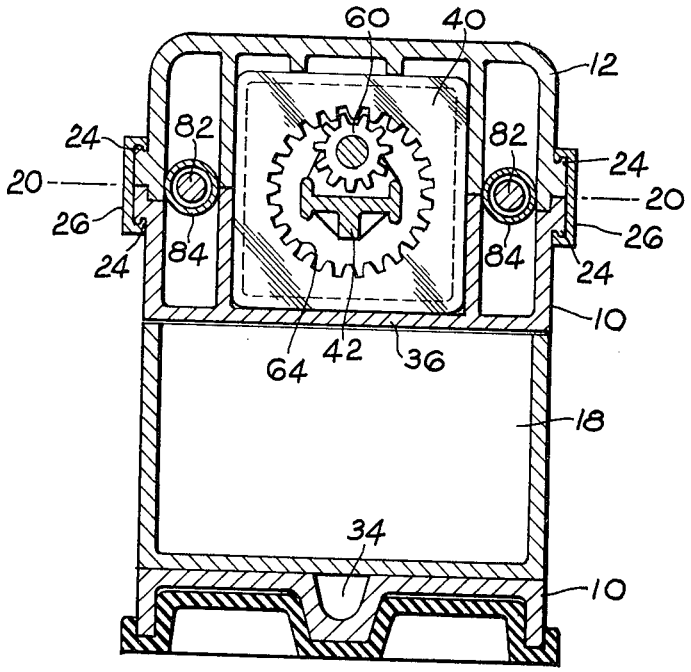
FIG. 3 is a section on the line 3—3 of FIG. 1.

As best seen in FIG. 3 of the drawings, the body parts 10, 12 meet at a plane 20 20, although one of the parts may be provided with a lip received in a groove in the other part, for better lateral location of the same. The parts are provided with external ribs 24 and covers 26 are fixed to enclose the ribs and secure the parts together. The body part 10 is substantially an open-topped hollow box with the front and side walls cut away to enable the shavings container 18 to be inserted therein. The base portion of the body part 10 is also provided with an axially extending aperture 34 to enable a clamp part to be inserted.

The body part 10 is provided near the plane 20 20 with a series of ribs and inter-rib grooves which extend both vertically and horizontally in a partition 36. In the illustrated design, two parallel recesses are afforded, either of which may locate a planetary gear plate 40 as described hereinafter.

The upper part 12 of the body is also generally in the form of a hollow open bottomed box, and provided with complementary ribs and inter-rib grooves for location of the plate 40 as described hereinafter.

Figure 1:
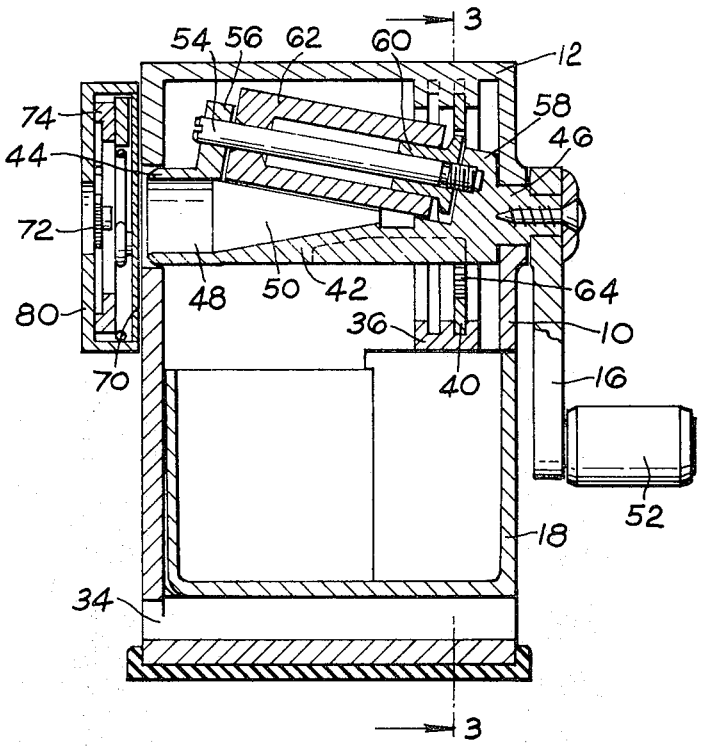
FIG. 1 is a vertical section of a pencil sharpener.
Figure 5:
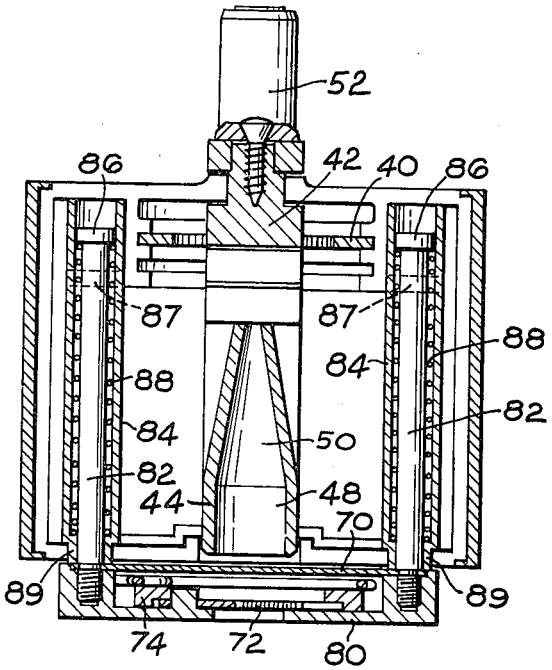
FIG. 5 is a section on the line 5—5 of FIG. 4.

The cutter assembly as shown in FIGS. 1, 3 and 5 comprises a carrier 42 having co-axial cylindrical portions 44, 46 at opposite ends, journalled in the body parts 10, 12, which have complementary semi-circular cut-outs for this purpose.

Preferably the body parts 10, 12 are moulded from a nylon, and the carrier 42 is moulded from a filled nylon, the two materials being selected so as to provide the necessary bearing qualities without any additional bearing mechanism being required.

The carrier has a bore 48 which is generally cylindrical and opens to bore 50 which is generally conical and the carrier is slotted along the length of the bore 50, the bores being adapted to receive the pencil end which is to be sharpened. Crank handle 16 carries knob 52 and is made fast with a projecting end of the carrier 42, so that rotation of the crank rotates the carrier.

Mounted on the carrier on an inclined spindle 54, which is supported in a lug 56 at one end of the carrier and in a lug 58 at the other end of the carrier, is a gear pinion 60 which is fast with cutter unit 62. The cutter unit may have helically extending teeth in known fashion.

In the arrangement shown in FIG. 1 the gear pinion 60 meshes with the internal annulus gear 64 (FIG. 3) provided on plate 40, which as previously explained is held axially in position by the co-operating ribs provided in the two body parts. It will be appreciated that rotation of the crank handle rotates the carrier and moves the gear 60 in planetary fashion around the annulus 64 and hence causes the cutter to rotate about its own axis as it is rotated about the axis of the pencil.

Figure 2:
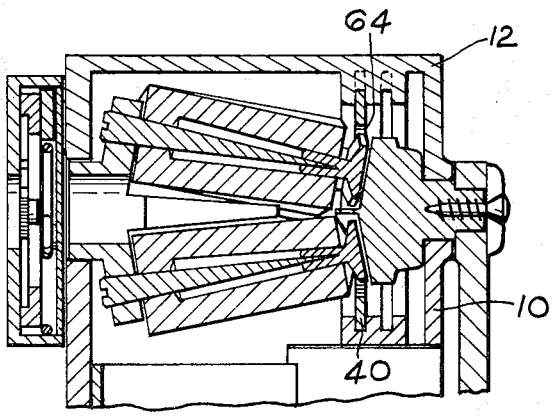
FIG. 2 is a fragmentary section similar to FIG. 1 but showing one of the possible alternatives.

In the arrangement shown in FIG. 2, two generally similar cutter units are provided and because of the different geometry necessary, the annulus gear 64 is located in the other of the recesses afforded by the construction.

Figure 4:
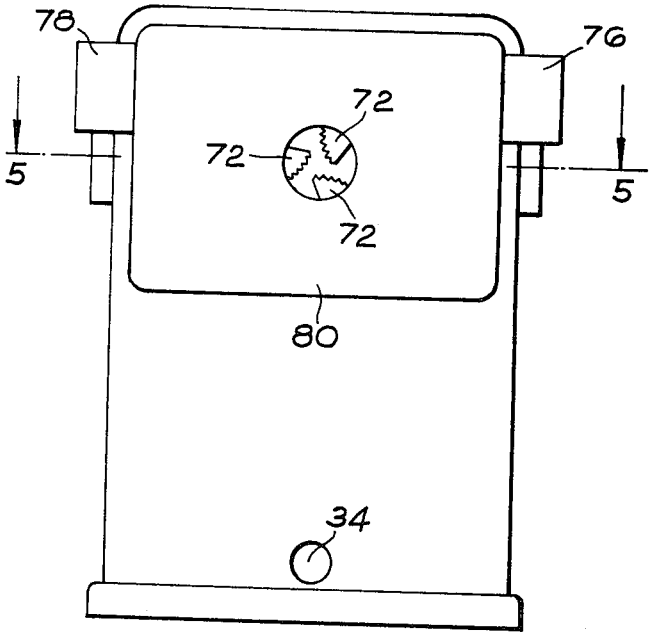
FIG. 4 is an end elevation.
Figure 6:
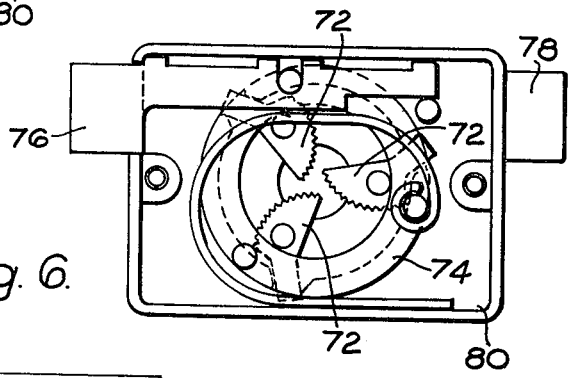
FIG. 6 is a rear elevation of the chuck mechanism

FIGS. 4 to 6 illustrate a self-feeding mechanism including a chuck for gripping the pencil and spring means for drawing the pencil into the sharpener, so as to complete the sharpening operation.

The chuck arrangement includes a plate 70 and cover 80 between which are pivotally mounted three cams 72 all of which are coupled to a driving ring 74 so that rotation of the ring closes the cams on the pencil or opens the cams from the pencil according to the direction of rotation. Slidably mounted between the 70 and cover plate 80 is a lever 76 which is coupled to the driving ring 74, and the cover 80 is also provided with a fixed abutment 78 so that the lever and abutment can be grasped between the finger and thumb of one hand to open the chuck, spring means being provided to return the chuck to the fully closed position as illustrated in FIG. 6. The cam pivots may be moulded or cast on part 80.

The complete chuck assembly is mounted on a pair of parallel pins 82, see FIG. 5, which run in guide tubes 84, and have heads 86 to act as abutments for helically coiled compression springs 88 which lie within the tubes and about the pins.

The tubes are received between the two body parts 10, 12 prior to fixing the same together and the co-operating body parts have recessed lugs 87 to support the tubes, and locate them in position. In the case of the body parts walls adjacent the chuck, the tube ends are shouldered at 89 for tube location.

The complete chuck assembly can be drawn away from the body parts by sliding of the pins within the tubes and accompanied by axial compression of the springs. If the chuck is then opened and a pencil inserted therein, the springs will draw the pencil into the sharpener and continue to draw the same further in as the pencil is shaved away by the cutter or cutters. It will be noted that no changes are required to the body whether or not the self-feeding mechanism and chuck is used, although it is preferred to provide for a small change to the design of the part 12 in cases where the self-feeding mechanism is not required, and this might be done by die inserts which could be removed or replaced according to need. The body part 10 would then be provided with the apertures for the tubes 84 in all circumstances, but the body part 12 would either be provided with a complementary recess or with a projecting semi-circular lug at each position, the latter being provided to engage in and fill the recesses in the part 10 when the self-feeding mechanism was not to be provided.

This arrangement of self-feeding mechanism for the pencils, comprising the tubes, pins, springs and chuck may be made as a sub-assembly and simply dropped into the body part 10 prior to fitting the body part 12. In the event of a fault in the sub-assembly, it can be replaced.

The externally visible parts 10, 12 and 18 in particular may be completely finished when removed from the moulding tools so as to require no machining or finishing operation thereon, and the plastics material used can be coloured to requirements. Assembly time will be short and consequently it is believed that pencil sharpeners as particularly described herein can be made much more economically than known designs.

We claim:

1. In a pencil sharpener comprising a body provided with an aperture for receiving one end of a pencil to be sharpened, a cylindrical cutter mounted for rotation about its axis, said cutter axis being offset from a second axis which is the axis of said aperture, means for rotating the cutter about its axis, and means for revolving the cutter in planetary fashion about the second axis, the improvement comprising two separate parts of said body which meet in at least one plane containing the said second axis, together with means for securing the said parts together, a gear pinion which is fast with the cutter, and an annulus gear fixed in the body, with which said gear pinion meshes to rotate the cutter during the planetary revolution of the cutter about the second axis, each of the two body parts being provided with a plurality of recesses, each of which is adapted to register with a complementary recess in the other body part to receive said annulus gear in a selected position.

* * * * *